US006854232B2

(12) United States Patent
Snauwaert

(10) Patent No.: US 6,854,232 B2
(45) Date of Patent: Feb. 15, 2005

(54) WELDMENT FOR INTERCONNECTING SLABS OF PRE-CAST CONCRETE

(76) Inventor: Robert M. Snauwaert, 9419 Dixie Hwy., Fairhaven, MI (US) 48315

( * ) Notice: Subject to any disclaimer, the term of this patent is extended or adjusted under 35 U.S.C. 154(b) by 13 days.

(21) Appl. No.: 10/345,521

(22) Filed: Jan. 16, 2003

(65) Prior Publication Data

US 2003/0101678 A1 Jun. 5, 2003

Related U.S. Application Data

(63) Continuation-in-part of application No. 09/884,321, filed on Jun. 19, 2001, now Pat. No. 6,668,506.

(51) Int. Cl.[7] ..... E04B 2/00

(52) U.S. Cl. ..... 52/582.1; 52/601; 52/715; 52/712; 52/367; 52/370; 52/369

(58) Field of Search ..... 52/593.1, 601, 52/715, 712, 367, 370, 369; 582/582.1

(56) References Cited

U.S. PATENT DOCUMENTS

| | | | | | |
|---|---|---|---|---|---|
| 975,368 | A | * | 11/1910 | Makowski | 52/344 |
| 1,280,485 | A | | 10/1918 | Kahn | |
| 1,622,697 | A | * | 3/1927 | Baily | 52/370 |
| 1,726,496 | A | * | 8/1929 | Kinninger | 52/370 |
| 1,777,359 | A | * | 10/1930 | Goldsmith | 52/370 |
| 2,188,445 | A | | 1/1940 | Saxe | 189/36 |
| 2,191,979 | A | * | 2/1940 | Bierbach | 52/370 |
| 2,607,450 | A | | 8/1952 | Horowitz | 189/36 |
| 2,611,262 | A | | 9/1952 | Dodson et al. | 72/42 |
| 2,644,740 | A | | 1/1954 | Cochrane | 72/107 |
| 3,359,022 | A | | 12/1967 | Russell | 287/189.36 |
| 3,585,711 | A | | 6/1971 | Hicks | 28/492 |
| 3,683,578 | A | | 8/1972 | Zimmerman | 52/274 |
| 3,958,954 | A | * | 5/1976 | Ehlenbeck | 428/584 |
| 3,993,341 | A | | 11/1976 | Bentley | 294/89 |
| 4,422,279 | A | * | 12/1983 | Powell | 52/745.12 |
| 4,724,649 | A | | 2/1988 | Lowndes, III | 52/583 |
| 4,930,677 | A | | 6/1990 | Jolliffee | 228/120 |
| 5,222,338 | A | | 6/1993 | Hull et al. | 52/405 |
| 5,402,616 | A | * | 4/1995 | Klein | 52/601 |
| 5,485,704 | A | | 1/1996 | Sandor, Sr. | 52/584.1 |
| 6,065,263 | A | | 5/2000 | Taguchi | 52/583.1 |
| 6,185,897 | B1 | * | 2/2001 | Johnson et al. | 52/583.1 |

* cited by examiner

*Primary Examiner*—Carl D. Friedman
*Assistant Examiner*—Nahid Amiri
(74) *Attorney, Agent, or Firm*—Gifford, Krass, Groh, Sprinkle, Anderson & Citkowski, P.C.

(57) ABSTRACT

A weldment connector for use with castable concrete slabs, each of the slabs including a length, width and depth and having at least one opposing and extending edge. The weldment connector has a substantially elongated and planar shaped front face and first and second legs which are both integrally formed with and extend from opposite end locations of the front face. The legs further extend in a combined axial and rotationally offset fashion relative the front face and each includes a horizontally extending and vertically spaced apart component with passes either above or below a mesh screen associated with the concrete slab. Additional features of the weldment connector include the width of the extending legs increasing, from a first end associated with the interconnecting and planar shaped front face, to outermost extending ends thereof. Also, pluralities of undulating portions may be formed in substantially width-wise extending fashion and at spaced apart locations along each of the legs and, in combination with the outwardly flaring of the legs, provides for increased gripping and holding forces of the associated concrete slab.

10 Claims, 2 Drawing Sheets

WELDMENT FOR INTERCONNECTING SLABS OF PRE-CAST CONCRETE

CROSS REFERENCE TO RELATED APPLICATIONS

The present application is a continuation-in-part of U.S. application Ser. No. 09/884,321, filed Jun. 19, 2001 now U.S. Pat. No. 6,668,506 and entitled Weldment for Interconnecting Slabs of Pre-Cast Concrete.

BACKGROUND OF THE INVENTION

1. Field of the Invention

The present invention relates generally to concrete weldment connectors and, more particularly, to an improved concrete weld clip for inter-engaging seam edges of first and second slabs of pre-cast concrete, and in particular for use with pre-fabricated concrete used in deck structures and the like. The weldment connector of the present invention in particular provides an improved construction which permits its use with shallower concrete forms than which is possible with prior art weldments. Additionally, the weldment connector of the present invention includes first and second extending leg constructions which are both rotationally offset and configured to increase and more evenly distribute, across the entire slabs, loading forces applied directly to the seam.

In further relevant part, the horizontally extending/terminating portions of the legs extend in substantially parallel and vertically spaced apart fashion and so that the legs extend over corresponding upper and lower sides of a reinforcing mesh screen associated with the given concrete slab. Additional features of the weldment connector include the width of the extending legs increasing, from a first end associated with the interconnecting and planar shaped front face, to outermost extending ends thereof. Also, pluralities of undulating portions may be formed in substantially widthwise extending fashion and at spaced apart locations along each of the legs and, in combination with the outwardly flaring of the legs, provides for increased gripping and holding forces of the associated concrete slab.

2. Description of the Prior Art

Weldment clips are well known in the art for interconnecting succeeding slabs of pre-cast concrete along a seamed edge. The purpose of such clips (also known as weldments or flange connectors) is to redistribute, into the interior of the concrete slabs, forces directed to the seamed edges (such as by vehicles traveling upon a parking deck structure). In the absence of such weldment clips, the concrete slabs would quickly crack, buckle and fracture along their seam edges.

A first example of such a prior art flange connector is illustrated in U.S. Pat. No. 6,185,897, issued to Johnson et al., and which adjoins adjacent concrete structural members. The flange connector discloses a one-piece steel member having a faceplate, opposing faceplate returns arranged at a 90° angle relative to the faceplate, succeeding and flattening bend portions and, finally, substantially planar and extending legs which terminate in perpendicularly configured reinforcing tabs.

The flange connector of Johnson, while disclosing a substantially functional weldment, has been found not to be practical for use with many pre-cast concrete forms of shallower depth and due to the cross sectional height of the front faceplate. Additionally, the construction of the first and second legs extending from the faceplate, and by virtue of the intermediate faceplate returns and flattening bends, have been found in practice to bend or crack under severe loading conditions. Further, the provision of the perpendicularly arrayed and end reinforcing tabs are disclosed as having holes formed therethrough for receiving a flexingly inserted and reinforcing steel bar. However, it has further been found in practice that the bending of such terminating edge portions of the weldment clip legs have the opposite effect of localizing the pressure forces applied along the seamed edge, and opposed to the desired effect of distributing such forces throughout the substantial interiors of the concrete slabs.

A further example of a concrete weldment and method of manufacture is disclosed in U.S. Pat. No. 5,402,616, issued to Klein. The weldment again includes a central plate having a planar, weldable surface along an edge of the concrete slab, the weldable surface being perpendicularly disposed to the horizontal plane of the concrete slab. A pair of outstanding arms extend, in substantially planar fashion, from the weldable surface and are embedded in the concrete slab. The outstanding arms have a constant height across their length and support a steel reinforcing mesh at a predetermined height during the concrete slab casting operation. A blockout is provided to the mold during the casting operation to keep the top edge and front surface of the weldable surface free and clear of concrete and both provides for thermal expansion of the weldable surface to minimize cracking and spalling during welding, as well as being removed (so as to be removable) from the mold after the concrete has hardened.

U.S. Pat. No. 3,958,954, issued to Ehlenbeck, discloses a weldment for embedment along the edges of concrete members and to permit welding joinder of adjacent members. The weldment is formed of sheet steel and includes an elongated central portion which is exposed when the weldment is emplaced. The central portion terminates in fold lines from which extend tapered tails that are embedded in the material. The fold lines are angularly displaced in a generally converging fashion and the tails are bent out of the plane of the central portion.

U.S. Pat. No. 4,930,677, issued to Jolliffee, teaches a concrete connector for a concrete structure and having two generally flat plates connected together along one edge to form an elongated structure having a substantially "L" shaped cross section. One plate is sized with an opening to allow unset concrete to flow therethrough and to hold the plate firmly within the concrete when it is set. The other plate protrudes from the set concrete and is available for connection with another and similar such connector by direct welding or clamping of the two plates together.

U.S. Pat. No. 4,724,649, issued to Lowndes, III, teaches another type of side weld plate, similar in respects to that previously described in Jolliffee and which includes an elongated body with a body section embedded in a concrete slab. An interconnecting flange section of the weld plate is positioned adjacent an edge of the concrete slab and so that the flange section provides an exposed weld surface which allows for adjacent concrete slabs also having a side weld plate to be welded together.

SUMMARY OF THE PRESENT INVENTION

The present invention is a weldment connector which is an improvement over prior art connectors in that it permits use with shallower concrete forms than possible with prior art weldments. Additionally, the weldment connector of the present invention includes first and second extending leg constructions which are both rotationally offset and vertically spaced apart in configuration and in order to both increase and more evenly distribute, across the entire slabs, loading forces applied directly to the seam. The configuration and construction of the extending legs also provides enhanced holding forces with the associated concrete slabs and renders them more resistant to cracking than has heretofore been experienced with other prior art types of weldment connectors.

The construction of parking deck structures, or other suitable concrete supported foundations, is well known in the art and typically includes a suitable pattern or form within which the concrete is poured and set, reference again being had to the description provided in Applicant's preceding application Ser. No. 09/884,321 from which the present application claims priority. It is also desirable to pre-mount a plurality of individual weldment connectors in spaced apart fashion along one or both of the elongated extending edges of the form and prior to pouring concrete and, to this end, a suitable aperture is defined in a front facing surface of each weldment connector.

Each weldment connector includes a substantially elongated and planar shaped front face having a specified length, width and height. First and second legs are integrally formed with and extend from opposite end locations of the front face. The legs extend in both a desired angular orientation, relative to an axis extending axially through the front face, as well as extending in a combined axial and rotationally offset fashion and so that each of the legs exhibits a significant horizontally extending component.

Each of the horizontally extending/terminating portions of the legs are further arranged in a vertically spaced apart fashion and so that a first (upper) leg extends above a mesh screen associated with the given concrete slab, whereas a second (lower) leg extends below the mesh screen. It has been found that arranging the legs in such a vertically and parallel spaced apart manner significantly increases both the strength of the weldment connector, as well as the holding forces exerted on the associated slab.

The width of each of the extending legs further increases, from first ends thereof associated with the interconnecting and planar shaped front face, to outermost extending ends. In a preferred arrangement, the legs each exhibit a width of approximately one (1") inch proximate the planar shaped front face, and increases to a width of one and one-quarter (1¼") inches at their outer terminating ends. Also, pluralities of undulating portions may be formed in substantially widthwise extending fashion and at spaced apart locations along each of the legs and, in combination with the outwardly flaring of the legs, provides additional gripping and holding forces of the weldment connector with the associated concrete slab.

In use, a second weldment connector is likewise embedded within a second selected slab of concrete in similar fashion and so that its corresponding front face extends along an opposing extending edge, in proximate fashion relative to the front face of the first weldment connector. A conventional weldment, such as is provided by an electric weld gun, secures together the front faces of the first and second connectors. In use, the weldment connectors act to redistribute, within the interior body of each concrete slab, load forces applied along its common seamed edge.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF PREFERRED EMBODIMENTS

Figure 1:
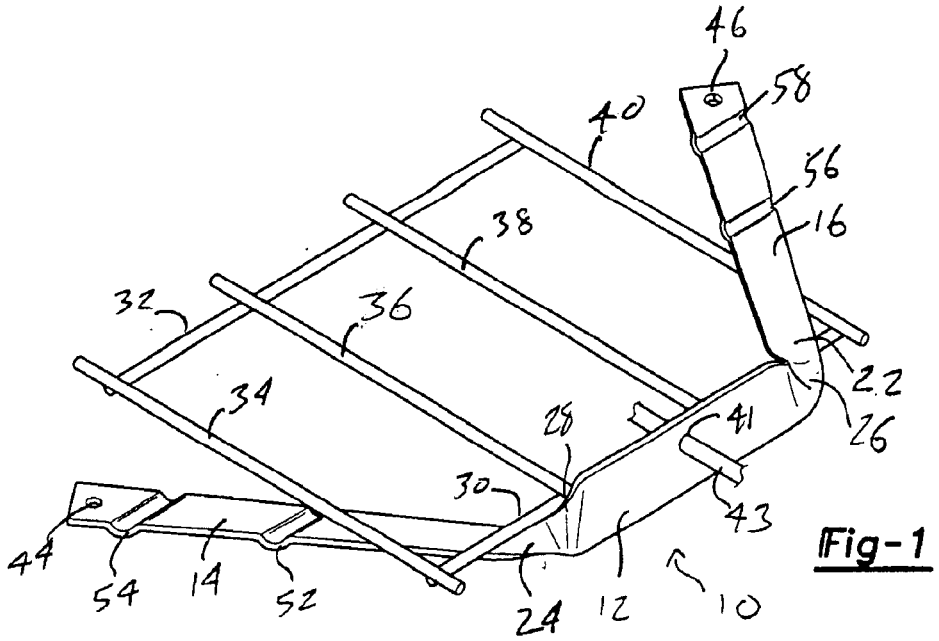
FIG. 1 is a perspective view of the weldment connector according to the present invention and which illustrates the legs extending in alternating fashion both above and below the associated mesh screen of the concrete slab.
Figure 2:
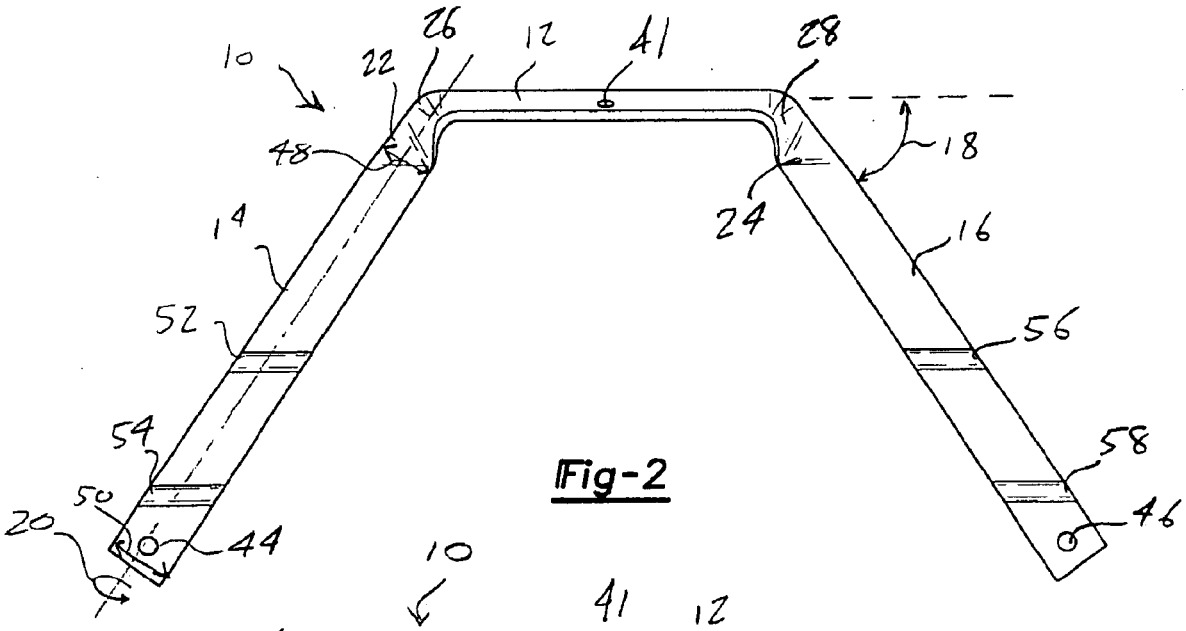
FIG. 2 is a top view of the weldment connector illustrated in FIG. 1 and further showing both the spaced apart undulating portions, as well as the width-increasing nature of each of the legs in directions towards their extending ends.
Figure 3:
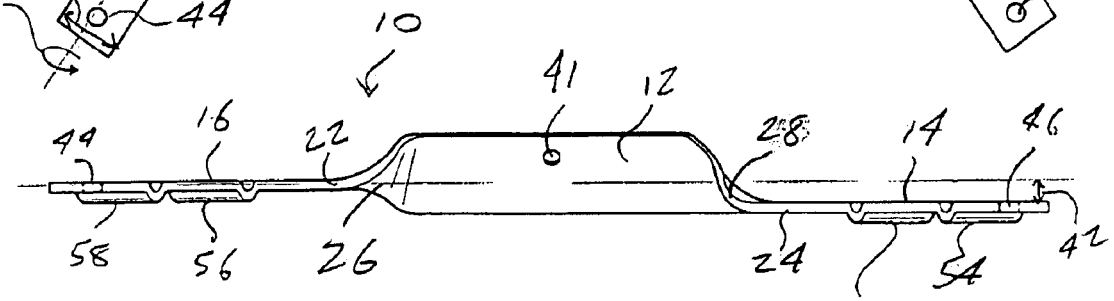
FIG. 3 is a front view of the weldment connector and which best illustrates the vertically displaced and parallel extending nature of the connector legs.

Referring now to FIGS. 1, 2, and 3, successive perspective, top, front views are shown of a weldment connector 10 according to the present invention. As described previously, the weldment connector 10 is an improvement over prior art connectors in that it permits use with shallower concrete forms than possible with prior art weldments.

Referencing once again Applicant's co-pending application Ser. No. 09/884,321, examples of such forms are illustrated in the side cutaway of FIG. 6 and for arraying first and second weldment connectors (see in phantom at 10' and 10"). Each form includes an upper stepped portion and a lower foot portion. A distinct advantage achieved by the weldment connectors 10 includes its ability to fit within the fairly shallow confines of the upper stepped portions of the forms and during casting of the concrete. A disadvantage encountered with prior art weldment connectors surrounds the excessive height of its associated front face (see again Johnson '897, Klein '616 and Ehlenbeck '954) and which thereby limits its use to other and certain forms which possess a deeper upper stepped portion (not shown).

Referring again to the previously referenced FIGS. 1, 2, 3 and 7, the weldment connector 10 is preferably constructed of a high grade steel material or, alternatively, can be constructed of any other suitable material exhibiting the necessary properties of strength and durability. The connector 10 includes a substantially elongated and planar shaped front face 12 having a specified length, width and height and which, as previously described, is configured for easily fitting within the confines of the upper stepped portions of the forms and illustrated in FIG. 6 of preceding application Ser. No. 09/884,321.

The weldment connector 10 of the present invention further includes first and second extending leg constructions 14 and 16. As best illustrated in each of FIG. 2, the legs 14 and 16 extend at a desired angle relative to an axis 18 extending in an axial direction through the front face 12. An additional and significant feature of weldment connector 10 further contemplates a combined axially and torsional/rotationally offset relationship of the legs 14 and 16 relative to the front face 12. In the preferred application, the terminating and flat planar surfaces of the legs 14 and 16 rotatively extend up to between 70° to 75° (see arrow 20) relative to the front face 12.

In the preferred embodiment, the legs 14 and 16 share a common height and thickness and such that the weldment connector 10 can be manufactured, in a suitable bending, forming or stamping operation. The material construction of the weldment connector is further preferably such as a stainless steel or 836 grade Carbon Steel upon which is applied a suitable material coating to protect the integrity of the connector in use.

It is further noted that, in comparison the combined torsional/rotational offset of the legs illustrated at 26 and 28 of the U.S. Ser. No. 09/884,321 application, the legs 14 and 16 in the present application complete their rotational offset to a substantially horizontally extending fashion (see at 22 and 24) more proximate in location to the front face 12. The range of offsetting of the legs is further noted at 26 and 28, respectively and located in between the opposite edges of front face 12 and the horizontally extending components 22 and 24 of legs 14 and 16.

Referring again to FIG. 1, a conventional wire screen mesh is illustrated and includes bars 30, 32 et seq. which are in interconnected in grid fashion with additional bars 34, 36, 38, 40, et seq. and so that a wire mesh grid is formed thereby. The mesh screen is a known component in the relevant art and is installed in the concrete form concurrent with the arrangement of the weldment connectors and the pouring of the concrete into the forms. Aperture 41 is also provided in the front face 12 and receives a suitable post or projection 43 (see FIG. 1) for mounting the weldment connector in place. The purpose of the aperture 41, referencing again in the side illustration of FIG. 6 in the preceding application U.S. Ser. No. 09/884,321, is to facilitate the mounting of the weldment connectors to associated and opposing locations in the upper stepped portions and of the forms and during the pouring/casting stage of the concrete slabs and this is further accomplished through the use of mounting fasteners or the like.

An advantage of the vertical offset and parallel spacing of the legs 14 and 16 (see also arrow 42 in FIG. 3) permits a first of the legs 14 to pass underneath the edge location of the mesh screen (see end bar 30) and in its inner and outwardly angled manner, whereas the second of the legs 16 is permitted to pass above and over the opposite facing side of the screen. In this manner, it has been determined that the construction of the weldment connector greatly increases the strength at the seam locations of the associated concrete slab. Also illustrated at 44 and 46 are apertures in the extending ends of each of the legs 14 and 16, respectively, and through which are engaged tie wires (not shown) for tying the ends of the weldment connector to associated locations of the wire mesh.

As is further best shown in FIG. 2, the width of each of the extending legs further increases, from first ends thereof associated with the interconnecting and planar shaped front face, to outermost extending ends. In a preferred arrangement, the legs each exhibit a width of approximately one (1") inch proximate the planar shaped front face (see arrow 48 in FIG. 2 for selected leg 14), and increases to a width of one and one-quarter (1¼") inches at their outer terminating ends (see further arrow 50). The effect of increasing, or outwardly flaring the width of the legs 14 and 16 towards their outer-most extending ends, has the effect of further increasing the holding forces of the weldment connector within the associated slab of concrete.

Also, pluralities of undulating portions, see at 52 and 54 for leg 14 and at 56 and 58 for leg 16, may be formed in substantially width-wise extending fashion and at spaced apart locations along each of the legs. In combination with the outwardly flaring of the legs 14 and 16, the undulating portions 52, 54, 56 and 58 provide additional gripping and holding forces of the weldment connector with the associated concrete slab. It is also contemplated that any plurality of undulating portions, ranging from a single to multiple numbers, may be associated with each of the extending legs and within the scope of the invention.

Figure 4:
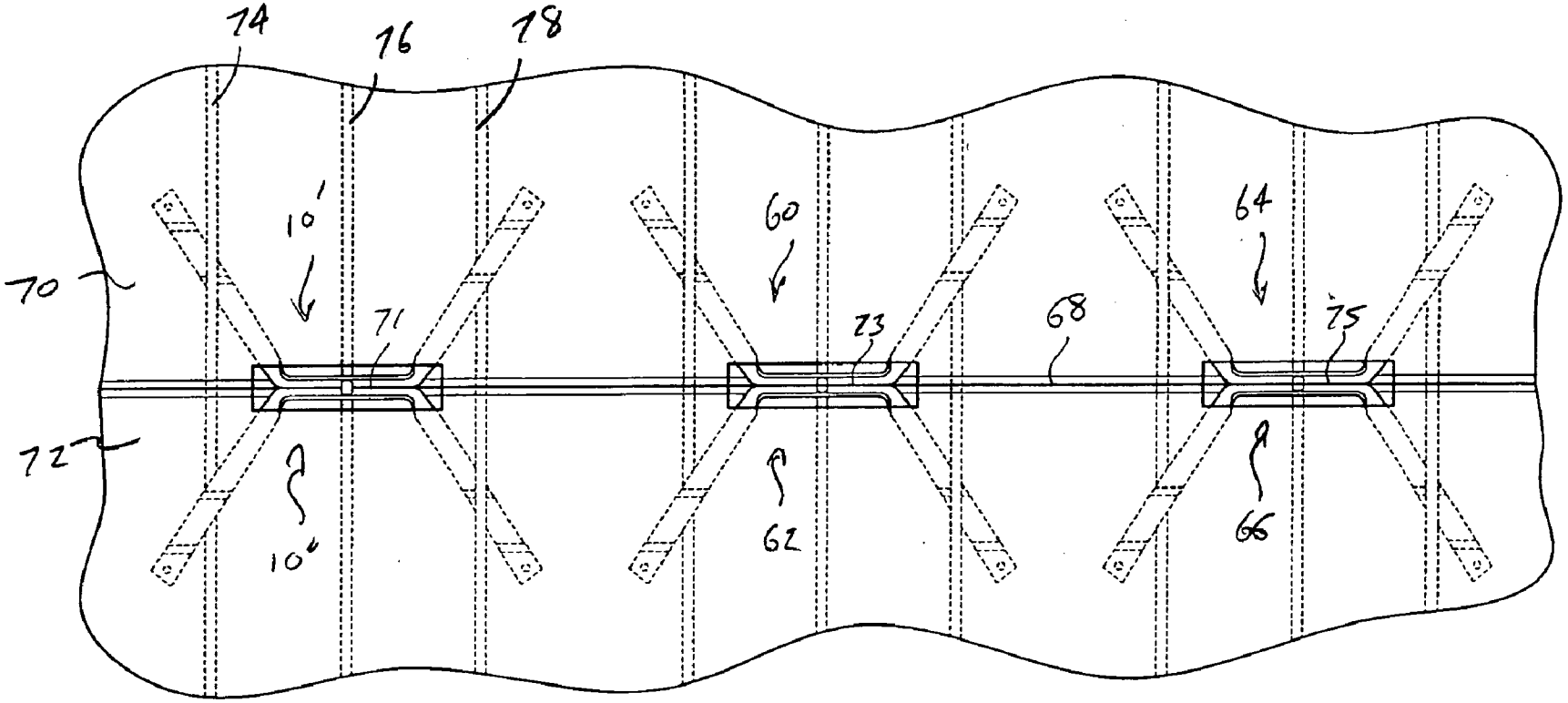
FIG. 4 is an overhead illustration of a plurality of interengaged pairs of weldment connectors according to the present invention.

Referring again to the drawing figures previously described in reference to the 09/884,321 application, as well as to FIG. 4 referenced in the present application, a plurality of individual weldment connectors are contemplated to be situated along either or both extending edges of the castable concrete slabs. Spaced apart pairs of weldment connectors (see again first pair at 10' and 10", as well as succeeding pairs 60 & 62 and 64 & 66) are provided at spaced apart and exposed locations along each opposing and exposed edge (making up common edge 68) of first 70 and second 72 concrete slabs.

As is also known, a suitable weld gun operation is provided to apply weldments at abutting end face locations, e.g. 71, 73 and 75 for slabs 10' & 10", 60 & 62, and 64 & 66, respectively). The individual pairs of weldment connectors are each arranged and secured together in similar fashion as previously described and additional inter-engaging support is provided the seamed edge 86 of the concrete slabs in the form of a plurality of spaced apart and parallel extending reinforcing bars 74, 76, 78, et seq., along with the wire meshing (previously referenced in FIG. 1) and embedded within and extending therebetween the first and second slabs of concrete.

The construction of the legs 14 and 16, as specifically provided by their combined angular extending and rotative offset, enables the weldment connectors to both increase and more evenly distribute, across the entire slabs, loading forces applied directly to the opposing seam. The configuration and construction of the extending legs also renders them more resistant to cracking than has heretofore been experienced with other prior art types of weldment connectors.

Having described my invention, additional preferred embodiments will become apparent to those skilled in the art to which it pertains and without deviating from the scope of the appended claims.

I claim:

1. A weldment connector in use with a plurality of castable concrete slabs, each of the slabs including a length, a width and a depth and each further having at least one opposing and extending edge, a wire mesh screen being placed within each of a plurality of forms associated with each of the concrete slabs and in proximity to one of the opposing and extending edges of a selected slab, said weldment connector comprising:

a substantially elongated and planar shaped front face;

first and second legs integrally formed with opposite end locations of said front face, said legs extending in a simultaneous axial and rotationally offset fashion relative to said front face and so that each defines a substantially horizontally extending portion which is vertically spaced apart relative to the other horizontally extending portion; and said legs of a first weldment connector being embedded within a first selected slab of concrete poured within the forms so that said front face extends in exposed fashion along its extending edge, a second weldment connector being embedded within a second selected slab of the concrete in like fashion and so that its front face extends along a corresponding and opposing extending edge in proximate fashion relative to said front face of said first weldment connector, said front faces of said first and second weldment connectors being interengaged to likewise engage the concrete slabs.

2. The weldment connector as described in claim 1, further comprising said first and second legs rotatively offsetting within a range of 70° to 75° relative said front face.

3. The weldment connector as described in claim 1, said weldment connector having a specified length, height and thickness and being constructed of a high grade steel material.

4. The weldment connector as described in claim 1, further comprising said width of each of the extending legs increasing, from first ends thereof associated with said interconnecting and planar shaped front face, to outermost extending ends.

5. The weldment connector as described in claim 4, further comprising said legs each exhibit a width of approximately one (1") inch proximate said planar shaped front face, and increasing to a width of one and one-quarter (1¼") inches at said outer extending ends.

6. The weldment connector as described in claim 1, further comprising pluralities of undulating portions formed in substantially width-wise extending fashion and at spaced apart locations along each of said legs.

7. The weldment connector as described in claim 2, further comprising said first and second legs angularly offsetting at a range of between 45° to 60° relative to an axis extending an axial direction along said front face.

8. The weldment connector as described in claim 1, further comprising an aperture formed through said faceplate to permit said weldment connector to be fastened to a supporting framework when pouring the associated precast concrete slab.

9. The weldment connector as described in claim 8, further comprising a weldment being applied between said proximate and opposing faces plates of said first and second connectors.

10. The weldment connector as described in claim 1, each of said first and second connectors having a specified length, height and thickness, and further comprising a plurality of spaced apart and parallel extending reinforcing bars and a wire meshing embedded within and extending therebetween the first and second slabs of concrete.

* * * * *